US006178940B1

(12) United States Patent
Gössling et al.

(10) Patent No.: US 6,178,940 B1
(45) Date of Patent: Jan. 30, 2001

(54) INTAKE SYSTEM FOR AN INTERNAL COMBUSTION ENGINE

(75) Inventors: Axel Gössling, Friedrichsdorf; Rainer Montigny, Bad Soden, both of (DE)

(73) Assignee: Mannesmann VDO AG, Frankfurt (DE)

( * ) Notice: Under 35 U.S.C. 154(b), the term of this patent shall be extended for 0 days.

(21) Appl. No.: 09/405,276

(22) Filed: Sep. 23, 1999

(30) Foreign Application Priority Data

Sep. 24, 1998 (DE) ..... 198 43 772

(51) Int. Cl.[7] ..... F02M 35/12
(52) U.S. Cl. ..... 123/184.57
(58) Field of Search ..... 123/184.57, 184.56; 181/229, 224

(56) References Cited

U.S. PATENT DOCUMENTS 4,846,300 * 7/1989 Boda ..... 181/229
4,911,111 * 3/1990 Matsunaga ..... 123/184.56
5,302,783 * 4/1994 Sadr et al. ..... 181/243
5,424,494 * 6/1995 Houle et al. ..... 181/229
5,541,374 * 7/1996 Sato et al. ..... 181/250
5,756,945 5/1998 Maeda et al. ..... 181/229
5,979,598 * 11/1999 Wolf et al. ..... 181/249

FOREIGN PATENT DOCUMENTS 4215416 11/1993 (DE) .

OTHER PUBLICATIONS

JP Patent Abstracts of Japan: 1–253559 A., M–915, Jan. 8, 1990, vol. 14, No. 3; 10047183 A., Feb. 17, 1998; and 08086256 A, Apr. 2, 1996.

* cited by examiner

*Primary Examiner*—Willis R. Wolfe
*Assistant Examiner*—Hyder Ali
(74) *Attorney, Agent, or Firm*—Martin A. Farber

(57) ABSTRACT

An intake system for an internal combustion engine, in particular an internal combustion engine driving a vehicle, having a resonator, wherein the resonator is designed as a resonator module (1), the resonator module (1) comprising a resonator housing (2) and a resonator-housing cover (21) and the resonator housing (2) and the resonator-housing cover (21) being connected permanently to one another.

8 Claims, 2 Drawing Sheets

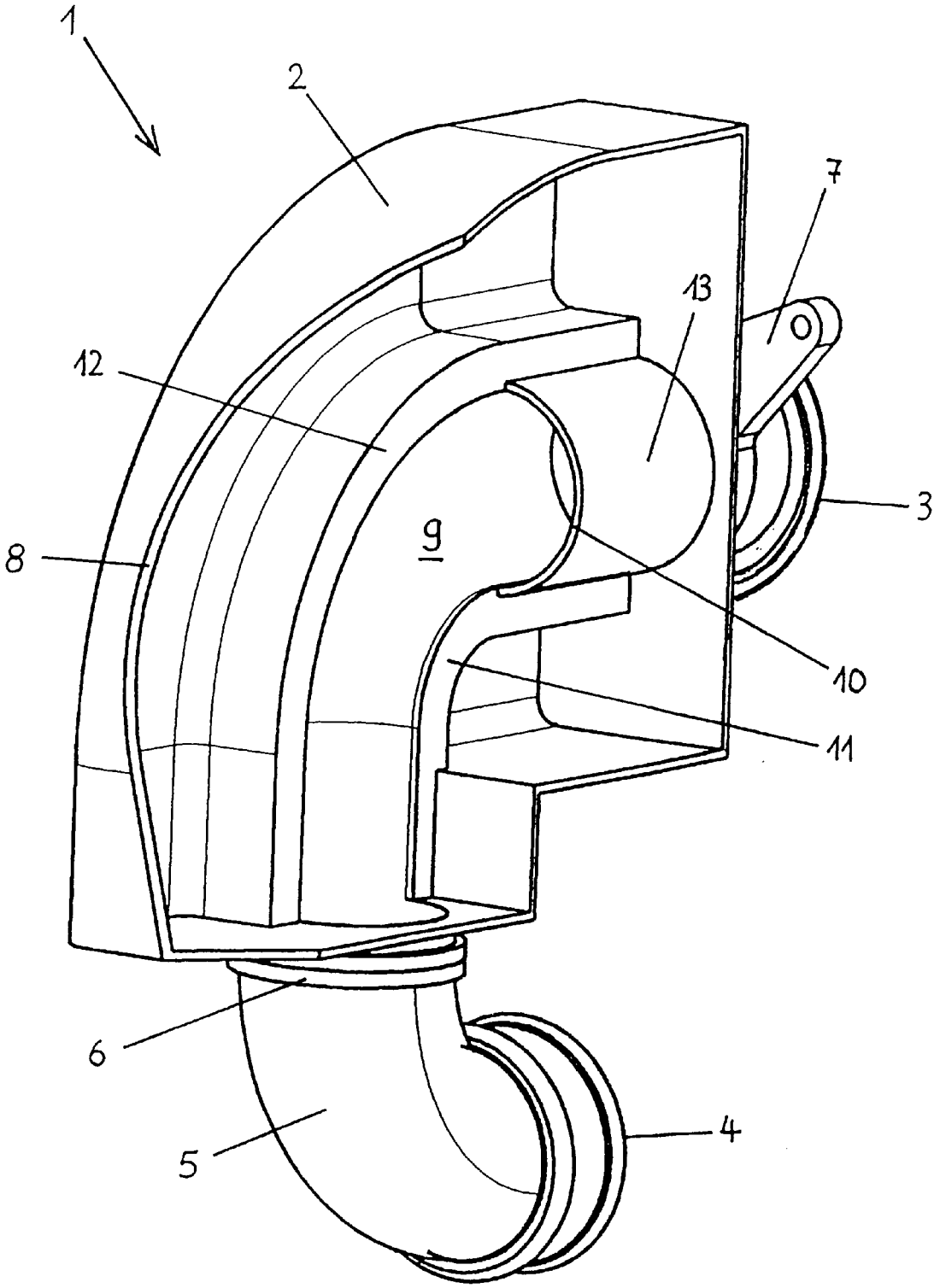
Figur 1

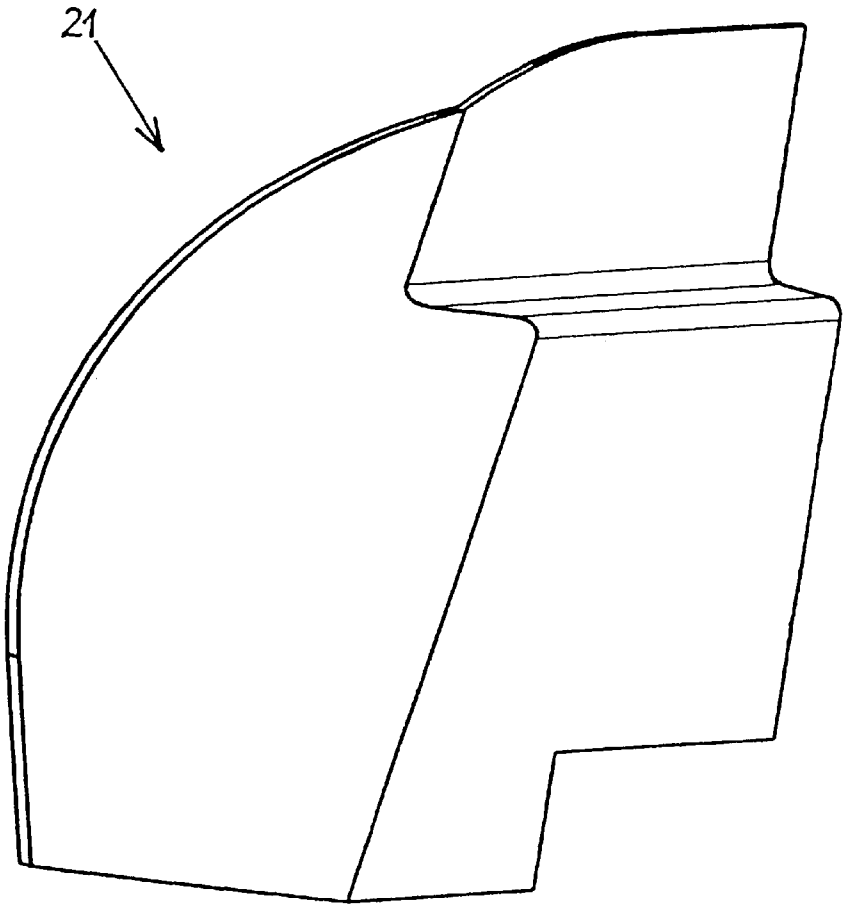
Figur 3
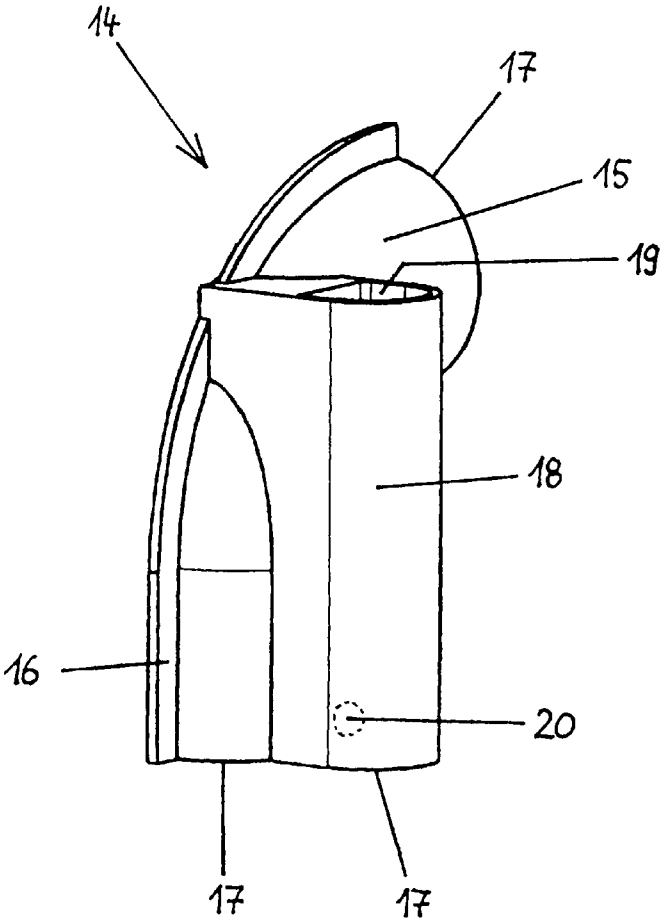
Figur 2

INTAKE SYSTEM FOR AN INTERNAL COMBUSTION ENGINE

FIELD AND BACKGROUND OF THE INVENTION

The invention relates to an intake system for an internal combustion engine, in particular an internal combustion engine driving a vehicle, having a resonator as a resonator module.

DE 42 15 416 A1 has disclosed an intake system in which an air feed line is arranged between an air filter and an injection device of the internal combustion engine. This air feed line is used to supply the internal combustion engine or its injection device with fresh air, the fresh air supplied being metered by means of a throttle valve. As the fresh air is drawn in by the internal combustion engine, vibrations occur in the air column in the air feed line and these cause unpleasant and disruptive intake noise. DE 42 15 416 A1 therefore proposes to fit the air feed line with a resonator, which is here designed as a Helmholtz resonator. For this purpose, both the Helmholtz resonator and the air feed line have a flange and the two components are connected to one another by these flanges. Although the troublesome intake noise can thereby be very largely eliminated, there is the disadvantage in the case of this intake system described in DE 42 15 416 A1 that it is in need of improvement in respect of the large number of components and assembly effort.

SUMMARY OF THE INVENTION

The object on which the invention is based is therefore to improve the intake system described at the outset in such a way that the assembly effort is reduced. Another aspect of the object is to obtain an intake system with a pleasing appearance, allowing the intake system to be accommodated more easily in the available installation space around the outside of the internal combustion engine.

According to the invention, the resonator is designed as a resonator module, the resonator module comprising a resonator housing and a resonator-housing cover and the resonator housing and the resonator-housing cover being connected permanently to one another. Once the resonator module has been produced, there is only a single component to be mounted in the intake system. For this purpose, for example, the air filter via which fresh air is drawn in for combustion in the internal combustion engine is attached to the inlet of the resonator module, and a connection with the injection device of the internal combustion engine is established at its outlet. It would also be conceivable instead for the resonator module and the air filter or its housing to form a single component, for example.

It is also advantageous that the resonator housing and the resonator-housing cover are connected permanently to one another since this provides a resonator module which can be matched in terms of its construction to the particular type of internal combustion engine on which it is to be used, thus reducing the number of components to be assembled. This means that the resonator module can be prefabricated and is available as a finished component during the production of the internal combustion engine, for example, or during the installation of the internal combustion engine in a vehicle. Moreover, it is an effective way of avoiding leaks, and sealing means can therefore also be dispensed with.

As a development of the invention, the resonator housing contains an intake line which is formed at least partially by the resonator housing. This further increases the integration of components of the resonator module, with the result that when the resonator module is fitted this not only automatically makes available the resonator itself but also provides the connection between the air filter and the injection device of the internal combustion engine. This also makes optimum use of the available installation space thanks to the compact resonator module.

As a development of the invention, that part of the intake line which is not formed by the resonator housing is covered by an intake-line cover. This has advantages in particular when the resonator module is produced from plastic, an aspect that will be discussed later.

As a development of the invention, the intake-line cover is also connected permanently to the resonator housing. Just as in the case of the permanent connection of the resonator-housing cover to the resonator housing, the permanent connection of the intake-line cover to the resonator housing has the advantage that a leak-tight connection is established without fail between the components involved, thereby preventing leaks and associated shifts in the resonant frequency in an effective manner. Moreover, a permanent connection of this kind (involving adhesive bonding for example) can be produced more easily and with greater reliability than, for example, a connection involving flanges with a gasket between them and the flanges bolted together. Here too, it goes without saying that this not only reduces the assembly effort but also allows assembly to be automated, something which is particularly effective and economical when producing resonator modules in series.

As a development of the invention, the intake-line cover has an air guide section which connects the intake line to the volume of the resonator housing. Thus not only the intake line but also the resonator is implemented within the resonator housing, further improving the handling of the resonator module during installation.

As a development of the invention, the intake-line cover is designed as a single component with the air guide section, which likewise reduces the number of components. This too is of particular advantage when producing the resonator module and all its components from plastic, further details of this being given below.

As a development of the invention, the intake system distinguished by its being manufactured from plastic, in particular a heat-resistant plastic. A heat-resistant plastic that retains its shape even at the relevant temperature in the engine compartment is required because high temperatures prevail during the operation of the internal combustion engine, which is accommodated in particular in an engine compartment of a vehicle, and these temperatures must not lead to a deformation of the resonator module. The term heat-resistant is intended to indicate that the resonator module manufactured from plastic is also exposed to lower temperatures (prevailing in winter for example), the temperatures in the engine compartment increasing greatly once the internal combustion engine has been put into operation. That is to say, even these temperature fluctuations must not lead to a deformation of the geometry of the resonator module.

As a development of the invention, the production of the resonator module of the intake system involves a mold and at least two cores for the production of the resonator housing by molding or injection molding from plastic. The mold forms the outer contours of the resonator housing and two cores are inserted into this mold, one core forming the resonator volume (and therefore the inner contours of the resonator housing) and the open section of the intake line produced at the same time as the resonator housing, and the second core forming the inner contours of a tubular piece of the intake line within the resonator housing, the outer contours of the tubular piece being formed by the first core. By virtue of this configuration, the resonator housing can be produced in a simple manner from plastic by means of a mold and at least two cores, using the molding or injection molding process, and the cores can be removed and the housing removed from the mold without problems.

As a development of the invention, the intake-line cover is also produced by means of a mold and a core, this allowing the intake-line cover to be produced in a single working step as a one-piece component which then simultaneously performs the task of covering the open area of the intake line and, at the same time, establishing the connection between the intake line and the resonator volume and of the resonator housing.

As a development of the invention, means for varying the resonator volume, in particular a flap or slide, and an actuating drive for adjusting the means for varying the resonator volume are integrated into the resonator module. The actuating drive can be controlled by a control device as a function of a parameter of the internal combustion engine, in particular the engine speed, for example. The use of the means for varying the resonator volume makes it possible to suppress or eliminate the intake noise not only at a particular frequency or in a particular narrow frequency range but also over a wider frequency range and as a function of the engine speed. Suitable means for varying the resonator volume are, for example, flaps or slides inserted at the inlet or at the end of the air guide section or in between. The actuating drive for adjusting the means for varying the resonator volume is either fastened within the resonator housing, on the intake-line cover for example, or else arranged outside the resonator module. Arranging it within the resonator module has the advantage that there is no need for passages through the walls of the resonator module, and it also means that sealing problems in this area are effectively avoided.

BRIEF DESCRIPTION OF THE DRAWINGS

An illustrative embodiment of a resonator module according to the invention for an intake system of an internal combustion engine is described below and explained with reference to the figures. The geometrical configurations shown in the figures are merely by way of example and can be varied or adapted with regard to the characteristics of the internal combustion engine and with regard to the available installation space without disregarding the effect to be achieved thereby or abandoning the inventive idea.

In the drawings:

FIG. 1 shows a resonator module before assembly,

FIG. 2 shows an intake line cover, and

FIG. 3 shows a resonator-housing cover.

DETAILED DESCRIPTION OF THE PREFERRED EMBODIMENT

FIG. 1 is a three-dimensional view of a resonator module 1 of an intake system of an internal combustion engine. The resonator module 1 comprises a resonator housing 2, a flange 3, by means of which the resonator module is connected to a fresh-air intake filter, being provided at one end of the resonator housing 2. At an other end of the resonator housing 2 is another flange 4, flange 4 being attached to the resonator housing 2 by means of a conduit section 5 that is, in particular, tubular and has another flange 6. The arrangement and alignment of flanges 3,4 and 6 is by way of example only and is chosen in accordance with the installation space and the position of the air filter connected to the flange 3 and in accordance with the position of the injection device of the internal combustion engine, which is connected to flange 4.

The resonator housing 2 furthermore has fixing means 7, illustrated by way of example, by means of which the resonator module 1 can be fixed in position.

The resonator housing 2 is not yet completely closed but has connection edges 8 or, more precisely, an all-round connecting edge 8, the connecting edge 8 matching the contours of a resonator-housing cover or the side parts thereof.

Arranged within the resonator housing 2 is an intake line 9, this intake line 9 being produced at least partially at the same time as the resonator housing 2. This intake line 9 and the resonator housing 2 thus form a one-piece component. The intake line 9 is not yet sealed over its entire length but is still open in the region of a connecting edge 10 or connecting surfaces 11 and 12. Since the intake line 9 is approximately tubular, it has a tubular piece 13 at one end, in particular at the end facing in the direction of flange 3, the tubular section 13 being straight, i.e. designed approximately as a cylindrical conduit. These configurations shown in FIG. 1 or similar ones of a corresponding form have the advantage that the resonator housing 2 can be produced by means of one mold and at least two cores. The mold defines the outer contours of the resonator housing 2 while one core defines the internal volume of the resonator housing 2, the open part of the intake line 9, the connecting edge 10, the connecting surfaces 11 and 12 and the surface of the tubular piece 13. The second core forms the inner core of the tubular piece 13, allowing core removal and removal of the finished resonator housing 2 from the mold after molding or injection molding.

FIG. 2 shows an intake-line cover 14, which covers the open area of the intake line 9, this area being shown in FIG. 1. The intake-line cover 14 comprises a cover 15 partially circular which covers the open area of the intake line 9 in the manner of an arc-shaped pipe. The intake-line cover 14 furthermore has connecting surfaces 16, which correspond to the connecting surfaces 11 and 12 of the resonator housing 2. At both ends of the intake-line cover 14, there are similarly connecting edges 17, corresponding on the one hand to the connecting edge 10 of the tubular piece 13 of the resonator housing 2 and, on the other hand, resting against an inner wall of the resonator housing 2 after the fitting of the intake-line cover 14. Once the intake-line cover 14 has been inserted and the mutually facing connecting edge and connecting surfaces have been connected permanently to one another, the previously open area of the intake line 9 is closed. The permanent connection is made, for example, by means of adhesive bonding, welding or the like.

The intake-line cover 14 also performs the task of establishing a connection between the now closed intake line 9 and the volume of the resonator housing 2. For this purpose, an air guide section 18 can be fitted as a separate component above the partially circular cover 15, it being particularly advantageous if the air guide section 18 is already integrally formed during the production of the intake-line cover 14 or is permanently connected to it. The air guide section 18 has an opening 19 which points in the direction of the resonator housing 2. Another opening 20, which is only indicated here, establishes a connection between the air guide section 18 and the intake line 9, more particularly in the vicinity of flange 6.

Having connected the intake-line cover 14 permanently to the resonator housing 2, it still remains to seal the resonator housing 2 with a resonator-housing cover.

For this purpose, a resonator-housing cover 21 (shown in FIG. 3) is placed on the resonator housing 2 together with the resonator housing 2, in accordance with the connecting edges 8 and is likewise connected in a sealing manner to the resonator housing 2 by adhesive bonding, welding or the like. After these production steps, which have been explained with reference to FIGS. 1 to 3, the resonator module 1 is ready for installation and can be connected to the air filter and the injection device of the internal combustion engine by way of flanges 3 and 4.

LIST OF REFERENCE NUMERALS

1. Resonator module
2. Resonator housing
3. Flange
4. Flange
5. Conduit section
6. Flange
7. Fixing means
8. Connecting edge
9. Intake line
10. Connecting edge
11. Connecting surface
12. Connecting surface
13. Tubular conduit section
14. Intake-line cover
15. Partially circular cover
16. Connecting surface
17. Connecting edge
18. Air guide section
19. Opening
20. Opening
21. Resonator-housing cover

What is claimed is:

1. An intake system for an internal combustion engine, in particular an internal combustion engine driving a vehicle, having a resonator, wherein the resonator is designed as a resonator module (1), the resonator module (1) comprising a resonator housing (2), an intake line cover (14), and a resonator-housing cover (21) and the resonator housing (2) and the resonator-housing cover (21) being connected permanently to one another;

wherein the resonator housing (2) contains an intake line (9) which is formed at least partially by the resonator housing (2); and a part of the intake line (9) has a longitudinal section which is not formed by the resonator housing (2) and is covered by the intake-line cover (14).

2. The intake system as claimed in claim 1, wherein the intake-line cover (14) is connected permanently to the resonator housing (9).

3. The intake system as claimed in claim 1, wherein the intake-line cover (14) has an air guide section (18) which connects the intake line (9) to the volume of the resonator housing (2).

4. The intake system as claimed in claim 3, wherein the intake-line cover (14) is formed as a single component with the air guide section (18).

5. The intake system as claimed in claim 1, wherein the intake system is manufactured from plastic, in particular a heat-resistant plastic.

6. The intake system as claimed in claim 1, which comprises a mold and at least two cores for the production of the resonator housing (2) by molding or injection molding.

7. The intake system as claimed in claim 1, which comprises a mold and a core for the production of the intake-line cover (14) by molding or injection molding.

8. The intake system as claimed in claim 1, wherein a configuration of the housing allows for varying the resonator volume by a flap or slide.

* * * * *